US007817946B2

(12) United States Patent
Murakami et al.

(10) Patent No.: US 7,817,946 B2
(45) Date of Patent: Oct. 19, 2010

(54) DEVELOPING DEVICE, IMAGE DEVELOPING METHOD, IMAGE FORMING APPARATUS, IMAGE FORMING METHOD, AND PROCESS CARTRIDGE

(75) Inventors: Hiroyuki Murakami, Toyonaka (JP); Masahide Inoue, Numazu (JP); Masayuki Hagi, Minoo (JP); Takuya Kadota, Kobe (JP); Yoshihiro Mikuriya, Nishinomiya (JP); Katsunori Kurose, Takarazuka (JP); Hideaki Yasunaga, Ibaraki (JP); Hiroaki Kato, Nagaokakyo (JP); Yoshimichi Ishikawa, Itami (JP); Kazuoki Fuwa, Toyonaka (JP)

(73) Assignee: Ricoh Company, Ltd., Tokyo (JP)

( * ) Notice: Subject to any disclaimer, the term of this patent is extended or adjusted under 35 U.S.C. 154(b) by 628 days.

(21) Appl. No.: 11/851,048

(22) Filed: Sep. 6, 2007

(65) Prior Publication Data

US 2008/0063957 A1 Mar. 13, 2008

(30) Foreign Application Priority Data

Sep. 7, 2006 (JP) ..... 2006-243223

(51) Int. Cl.
*G03G 15/08* (2006.01)

(52) U.S. Cl. ..... 399/284

(58) Field of Classification Search ..... 399/274, 399/284

See application file for complete search history.

(56) References Cited

U.S. PATENT DOCUMENTS 5,177,537 A * 1/1993 Okano et al. ..... 399/222
6,272,300 B1 * 8/2001 Fujiwara et al. ..... 399/113
7,398,040 B2 * 7/2008 Yoshida ..... 399/284
7,695,885 B2 4/2010 Yasunaga et al.
2006/0204882 A1 9/2006 Nozaki et al.
2006/0210902 A1 9/2006 Nakamura et al.
2006/0275686 A1 12/2006 Kadota et al.
2006/0292474 A1 12/2006 Mikuriya et al.
2007/0026335 A1 2/2007 Yamamoto et al.
2007/0059625 A1 3/2007 Yamamoto et al.
2007/0122729 A1 5/2007 Katoh et al.

(Continued)

FOREIGN PATENT DOCUMENTS

JP 3-294864 12/1991

(Continued)

OTHER PUBLICATIONS

Nippon Gazo Gakkai shi or "Journal of the Imaging Society of Japan", vol. 39, No. 3, at p. 259 (with partial English translation).

*Primary Examiner*—David M Gray
*Assistant Examiner*—Gregory H Curran
(74) *Attorney, Agent, or Firm*—Oblon, Spivak, McClelland, Maier & Neustadt, L.L.P.

(57) ABSTRACT

The present invention provides a developing device that allows for maintaining the conveyance amount of a toner within a certain definite range. A developing device 12 of the present invention is provided with a toner conveying unit 13 configured to convey a first toner and a controlling member 15 configured to control the thickness of a toner layer formed with the first toner conveyed by the toner conveying unit 13, wherein a second toner provided with a charged amount per unit mass that differs from a charged amount per unit mass of the first toner is applied over the surface of the controlling member 15.

12 Claims, 1 Drawing Sheet

U.S. PATENT DOCUMENTS

| | | | |
|---|---|---|---|
| 2007/0148568 | A1 | 6/2007 | Kadota et al. |
| 2007/0190443 | A1 | 8/2007 | Hagi et al. |
| 2007/0207399 | A1 | 9/2007 | Kadota et al. |
| 2008/0232857 | A1 | 9/2008 | Matsumoto et al. |

FOREIGN PATENT DOCUMENTS

| | | |
|---|---|---|
| JP | 4-214568 | 8/1992 |
| JP | 2754539 | 3/1998 |
| JP | 11-095480 | 4/1999 |
| JP | 2933724 | 5/1999 |
| JP | 11-184239 | 7/1999 |
| JP | 3007693 | 11/1999 |
| JP | 2002-031913 | 1/2002 |
| JP | 2003-186240 | 7/2003 |
| JP | 3571900 | 7/2004 |
| JP | 2004-264428 | 9/2004 |
| JP | 2004-279912 | 10/2004 |
| JP | 2004-279913 | 10/2004 |
| JP | 2006-330689 | 12/2006 |

* cited by examiner

DEVELOPING DEVICE, IMAGE DEVELOPING METHOD, IMAGE FORMING APPARATUS, IMAGE FORMING METHOD, AND PROCESS CARTRIDGE

BACKGROUND OF THE INVENTION

1. Field of the Invention

The present invention relates to a developing device, an image developing method, an image forming apparatus, an image forming method and a process cartridge.

2. Description of the Related Art

Conventionally, in electrophotography, an image has been formed by developing a latent electrostatic image formed by charging or exposing a photoconductor surface with color toners to form a toner image, transferring the toner image onto an image transfer member such as a transfer sheet and fixing the toner image formed on the transfer sheet using a heat roller or the like.

Dry process developing methods employed in electrophotographic process and electrostatic recording etc. are divided into two streams, i.e., a method using a two-component developer containing a toner and a carrier and a method using a one-component developer containing no carrier. The former method, i.e., the method using a two-component developer allows for obtaining a favorable image in relatively stable condition, however, it is difficult to obtain images having constant quality over a long period of time because deterioration of carrier and a variation in mixture ratio of a toner and carrier and the like easily occur. Further, the method using a two-component developer is disadvantageous in controlling maintenance of developing devices and in making an developing device compact. For this reason, the latter method, i.e., the method using a one-component developer which does not have the disadvantage has been a focus of attention.

In the method using a one-component developer, a toner which serves as a developer is conveyed by a toner conveyance member and a unit configured to visualize a latent electrostatic image formed on a photoconductor using the toner is used. However, in the conveyance, a toner layer conveyed over the toner conveyance member surface must be sufficiently thinned. When a material having a high electric resistance is used as a toner, the toner needs to be charged using a developing device, and thus a toner layer must be particularly thinned. When a toner layer is thick, only the surface of the toner layer is charged and it is difficult for the entire toner layer to be charged evenly.

For this reason, for a unit used to adjust the thickness of a toner layer on a toner conveyance member (a toner layer thickness controlling unit), various methods have been proposed such as using a controlling member. As a primary example, there is a method in which a toner layer thickness controlling blade as a controlling member is placed so as to face a toner conveyance member and a toner conveyed over the surface of a toner conveyance member is pressed with the toner layer thickness controlling blade to thereby control the toner layer thickness. Further, a method is also proposed in which instead of the toner layer thickness controlling blade, a roller is made to contact with a toner to thereby obtain a similar effect.

In an image developing step, i.e., at the time of developing an image on a photoconductor, in a toner layer formed on the surface of a developing roller, which serves as a toner conveyance member, by the toner layer thickness controlling unit, a toner residing near the developing roller surface has an extremely high charge. Since the toner having an extremely high charge is strongly attracted to the developing roller surface, the transfer rate of the toner from the developing roller onto a latent electrostatic image on the photoconductor is reduced and a charge-up phenomenon easily occur.

When a charge-up phenomenon occurs, the surface layer of a toner layer formed on a developing roller surface becomes harder to be charged and the charged amount of the toner is reduced. As a result, background smear in non-image-formed portions, toner bleed, toner scattering and the like easily occur.

To prevent these phenomena, there is a need to control such that the charged amount of a toner layer formed on the surface of a developing roller is uniformed.

When a toner layer formed on a developing roller surface cannot be efficiently thinned and uniformly charging of the toner layer cannot be efficiently controlled, a phenomenon that a conveyance amount of a toner on the developing roller is increased more than necessary easily occurs in the course of continuation of printing to the developing device lifetime. Due to occurrence of the phenomenon, not only background smear in non-image formed portions, toner bleed and toner scattering occur but also nonuniformity of image formed portions is easily conspicuous.

Such a phenomenon tends to take place particularly when a power source of a copier is turned off overnight or longer and thereafter the copier is started up. The reason why the phenomenon tends to take place is that the adsorbability of a toner onto a developing roller is increased more than necessary because its high toner charged amount in restarting a copier, and then the toner conveyance amount is largely increased.

To solve these problems, it is necessary to prevent the toner charged amount from being excessively increased and to control the toner conveyance amount within a certain definite-range, if circumstances allow.

For example, Japanese Patent (JP-B) No. 2754539 proposed a method in which a tone conveyance amount is preferably controlled within a range of 0.5 $mg/cm^2$ to 0.75 $mg/cm^2$ so as to appropriately control the toner conveyance amount.

Similarly to the above method, for example, Japanese Patent Application Laid-Open (JP-A) No. 2004-279912 proposes a method in which a toner amount of a toner on a toner bearing member is controlled within a range of 0.2 $mg/cm^2$ to 0.45 $mg/cm^2$ and Japanese Patent Application Laid-Open (JP-A) No. 2004-279913 proposed a method in which a toner amount of a toner on a toner bearing member is controlled within a range of 0.45 $mg/cm^2$ to 1.0 $mg/cm^2$.

For a method of uniformly charging a toner on a developing roller, which is another approach to solve the above-noted problems, adding the following various treatment agents in a toner is known.

For the treatment agent, for example, Japanese Patent Application Laid-Open (JP-A) No. 2002-31913 proposes to use magnesium silicate minerals (attapulgite, sepiolite etc.).

For the treatment agent, for example, Japanese Patent Application Laid-Open (JP-A) Nos. 3-294864 and 4-214568 respectively propose to use a silicone oil-treated magnesium silicate.

For the treatment agent, for example, Japanese Patent Application Laid-Open (JP-A) No. 11-95480 also proposes to use a toner coated with a silicate fine powder (magnesium silicate) at a coverage of 60% to 100%.

For the treatment agent, for example, Japanese Patent Application Laid-Open (JP-A) No. 11-184239 also proposes to use a titanium acid fine powder.

For the treatment agent, for example, Japanese Patent Application Laid-Open (JP-A) No. 2003-186240 also proposes to use a titania.

Further, as a lubricant to apply a contact portion between a developing blade and a developing roller, for example, Japanese Patent Application Laid-Open (JP-A) No. 2004-264428 proposes to use a spherically shaped polymer particle that has a particle diameter much smaller than the weight average particle diameter of the toner and has reverse polarity to that of the toner.

However, the method disclosed in JP-B No. 2754539 specifies combinations of external additives to be used, however, the method has a difficulty in controlling a toner conveyance amount within a specific range while preventing desorption and imbedding of various external additives.

The methods disclosed in Japanese Patent Application Laid-Open (JP-A) Nos. 2004-279912 and 2004-279913 respectively specify a mass ratio of a negatively chargeable silica fine particle and a positively chargeable silica fine particle. However, the methods respectively have a difficulty in controlling a toner conveyance amount within a desired range for the above-noted reasons. Even if a toner conveyance amount is controllable, the method disclosed in JP-A No. 2004-279912 has a difficulty in ensuring a sufficient developed amount of a toner with the use of the lower limit value of the specified range of mass ratio for the negatively chargeable silica fine particle and the positively chargeable silica fine particle and is likely to cause image density defects. The method disclosed in JP-A No. 2004-279913 has a difficulty in uniformly charging a toner with the use of the upper limit value of the specified range of mass ratio for the negatively chargeable silica fine particle and the positively chargeable silica fine particle and is likely to cause background smear in non-image formed portions, toner bleed and toner scattering. Further, it is difficult to prevent occurrence of image nonuniformity.

In the method disclosed in JP-A No. 2002-31913, a magnesium silicate mineral used as a treatment agent has a high moisture content, and the method is likely to cause charge defects even in normal use environments as well as to cause troubles attributable to charge defects such as background smear, toner bleed, toner scattering and the like.

The methods disclosed in Japanese Patent Application Laid-Open (JP-A) Nos. 3-294864 and 4-214568 respectively have problems of causing degradation in toner flowability and increases in charged amount by the use of the silicone oil and of causing toner conveyance defects and reductions in image density in a developing device.

In the method disclosed in JP-A No. 11-95480, when a negatively chargeable toner is used, there is a problem that a reversely charged toner is likely to be generated, which easily leads to occurrence of background smear. This is caused by physical property of magnesium silicate contained in the toner that magnesium silicate is likely to be positively charged by influence of magnesium oxide (MgO) which is likely to have a strongly positive charge, as instructed in "Relation of Electronegativity" (see Nippon Gazo Gakkai shi or "Journal of the Imaging Society of Japan" Vol. 39, No. 3 at page 259).

The method disclosed in JP-A No. 11-184239 has a problem that a leaked amount of charge is large because the electric resistance of the titanium acid fine powder is low. Therefore, background smear, toner bleed and toner scattering easily occur. Further, the titanium acid fine powder is prone to break away from a toner and when a contact-charge process is employed, the titanium acid fine powder causes contamination of the contact-charge members and charge defects of the used photoconductor, ending up with occurrence of image defects.

Further, the method disclosed in JP-A No. 2003-186240 has a difficulty in adjusting the additive amount of titania because titania is a material having electrically low resistance and a high dielectric constant. When a large amount of titania is added, the leaked amount of charge is large, which causes reduction in charged amount of the entire toner. In contrast, when the additive amount of titania is small, it causes an increase in charged amount. Thus, in either case, background smear, toner bleed and toner scattering are likely to occur. Further, when a titania having a relatively large particle diameter is used, the titania is prone to break away from the toner. Accordingly, when a contact-charge process is employed, titania causes contamination of the contact-charge members and charge defects of the used latent electrostatic image bearing member, ending up with occurrence of image defects.

Furthermore, the method disclosed in JP-A No. 2004-264428 uses a developing device using a one-component nonmagnetic toner, the developing device is not a developing device of which such a toner is applied to a controlling member (blade).

BRIEF SUMMARY OF THE INVENTION

The object of the present invention is therefore to provide an image forming apparatus, an image forming method and a process cartridge each of which allows for maintaining the conveyance amount of a toner within a certain definite range.

The present invention is proposed in view of the present situation and aims to solve the various conventional problems and to achieve the following objects.

The developing device of the present invention has at least a toner conveying unit configured to convey a first toner and a controlling member which makes contact with the toner conveying unit wherein a second toner provided with a charged amount per unit mass that differs from a charged amount per unit mass of the first toner is applied over the surface of the controlling member.

The present invention can provide a developing device, an image developing method, an image forming apparatus, an image forming method and a process cartridge each of which allows for holding the conveyance amount of a toner within a certain definite range.

DETAILED DESCRIPTION OF THE INVENTION

Figure 1:
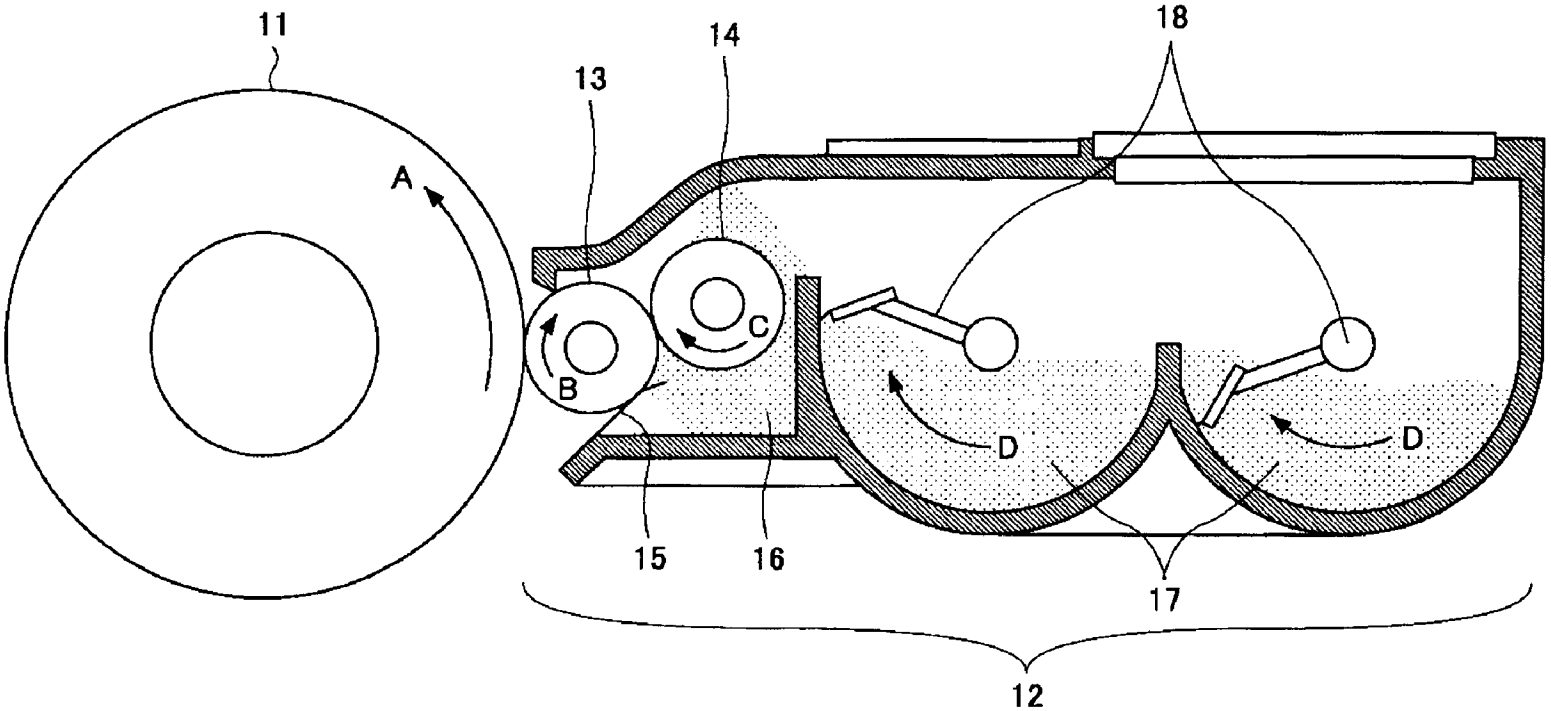
FIG. 1 is a block diagram exemplarily showing an embodiment of the developing device of the present invention.

Hereinafter, the best mode embodiment of the present invention will be described.

In a developing device to develop a latent electrostatic image formed on the surface of a photoconductor in an image forming apparatus, generally, a toner is preliminarily applied over the surface of a controlling member that is configured to make contact with the developing roller and charge the toner, such as a toner layer thickness controlling blade, before shipping. When the developing roller starts to rotate in a condition where none is applied to between a developing roller and a controlling member, there is a possibility that the frictional resistance is increased to induce abnormal friction of the developing roller, etc. For this reason, it is necessary that a toner be preliminarily applied to a contact portion between a developing roller and a controlling member to make the developing roller have a bearing effect. A toner applied to a contact portion between a developing roller and a controlling member is ultimately a part of toner used for developing, and thus conventionally, a toner used for developing has been used as it is.

A one-component nonmagnetic toner is charged by undergoing a large frictional force in between a developing roller and a controlling member. However, it has been known that the repeatedly undergoing a large frictional force, the charge ability of the developing roller is degraded with a lapse of time. Further, it has been also known that attrited or worn fine convexoconcaves formed on the developing roller changes the allowable conveyance amount of a toner residing on a developing roller. Due to influences, the amount of toner conveyed by a developing roller per unit of the roller surface area (hereinafter, described as "M/S") is not constant and varies with use, resulting in adverse affect when developing a latent electrostatic image on a photoconductor surface.

When the value of the "M/S" is large, i.e, when an excessive amount of toner is conveyed, the charged amount of toner by means of a controlling member is insufficient, it causes abnormal images such as toner fogging and toner dust caused by a toner charge defect. In contrast, the M/S value is small, the amount of toner used for developing is scant, it causes insufficient image density. Summarizing above, to continuously output normal images, it is necessary that the conveyed amount of a toner on a developing roller be constant as far as possible without varying with time.

When the M/S value is excessively large in an image forming apparatus before shipping, a phenomenon is observed in which the M/S value is once increased by continuously using the image forming apparatus and thereafter the M/S value gradually decreases. It is presumed that the phenomenon that the M/S value is gradually decreasing is caused by a reduced toner conveyance amount resulting from attrited or worn fine convexoconcave portions that have been formed on a developing roller surface as described above and caused by reduced toner flowability and charge ability when the toner suffers from a physical stress and external additives adhering on the toner surface are imbedded in the toner surface or broken away from the toner surface.

The embodiment of the developing device is particularly characterized by use of a toner having properties that are different from those of an ordinary toner typically used in developing, as a toner to be applied to between a developing roller and a controlling member (or to be applied over the surface of a controlling member), expecting a bearing effect, before shipping. With this, it is possible to keep the conveyance amount of the toner by means of a developing roller constant, to prevent increases and decreases in M/S value when the image forming apparatus is continuously used and to keep the M/S value on a certain level. This is conceivable because abrasion of fine convexoconcaves formed on the developing roller is reduced and toner surface abrasion that could be caused by physical stress is reduced.

Hereinafter, a toner to be used in ordinary developing is referred to as a first toner, and the toner to be applied over the surface of a controlling member, expecting a bearing effect, is referred to as a second toner, respectively.

By setting the charge-build up property of the second toner lower than that of the first toner, the M/S value can be held on a certain level before shipping. To achieve a toner having low charge-build up property, it is necessary to reduce temporal changes of external additives adhering on the toner surface. Specifically, by reducing the additive amount of $SiO_2$ to which negative charge ability can be easily imparted, it is possible to produce a toner in which imbedding of external additives or the like hardly occur with time-of-use.

In the embodiment of the present invention, a toner using a large amount of external additives such as the following forsterite and steatite that are capable of suppressing the charged amount of a negatively charged toner is used as the second toner. Hereinafter, both component compositions of the first toner and the second toner will be described.

A toner particle constituting a full-color image forming toner used in the embodiment contains at least a binder resin and a colorant and is subjected to a surface treatment with inorganic fine particles. At least one of the inorganic fine particles is preferably an inorganic fine particle composed of a composite oxide having a relative dielectric constant measured with 1 MHz of 2 to 10 and a volume resistivity of $10^{11}$ Ω·cm or more. More preferably, at least one of the inorganic fine particles is preferably an inorganic fine particle composed of a composite oxide having a relative dielectric constant measured with 1 MHz of 3 to 9 and a volume resistivity of $10^{12}$ Ω·cm or more. When the relative dielectric constant is lower than 2, the inorganic fine particle cannot function as a charge auxiliary agent. When the relative dielectric constant is greater than 10, it will be a cause of charge-up, resulting in nonuniformly charge of the toner in the developing device. When the volume resistivity is lower than $10^{11}$ Ω·cm, the surface resistivity of a charging member used to charge a photoconductor is reduced when the toner adheres on the charging member, causing charge defects of the photoconductor.

Composite oxides represented by the following General Formula I can be preferably used as external additives.

$$[M1]_a Si_b O_c \qquad \text{General Formula I}$$

In General Formula I, "M1" represents a metal element selected from strontium (Sr), magnesium (Mg), zinc (Zn), cobalt (Co), manganese (Mn) and cerium (Ce); "a" and "b" respectively an integer of 1 to 9; and "c" is an integer of 3 to 9.

To extract the effects of the embodiment of the present invention, it is particularly preferable that the composite oxide is forsterite ($Mg_2SiO_4$ ($2MgO.SiO_2$) or steatite ($MgSiO_3$ ($MgO.SiO_2$)).

The primary diameter of the composite oxide is typically 0.05 μm to 1 μm and preferably 0.08 μm to 1 μm. When the primary particle diameter of the composite oxide is smaller than 0.05 μm, the composite oxide is imbedded in the toner particle surface by physical stress at a thin layer-forming unit of the developing device. Accordingly, the effect of the developing device cannot be expected after continuously used. When the primary particle diameter of the composite oxide is greater than 1 μm, the composite oxide is broken away from the toner surface and thus the effects of the developing device cannot be expected after continuously used.

The composite oxide is used with an additive amount of 0.1 parts by mass to 1.5 parts by mass, preferably with an additive amount of 0.2 parts by mass to 1.5 parts by mass to 100 parts by mass of the toner base. When the additive amount of the composite oxide is less than 0.1 parts by mass, the effect as a charge auxiliary agent cannot be exerted, causing charge-up and nonuniform charge of the toner in the developing device. When the additive amount of the composite oxide is more than 1.5 parts by mass and the toner is used as a negatively chargeable toner, a reversely charged toner is easily generated, resulting in a cause of background smear. The reason is that when magnesium silicate such as forsterite and steatite is used as the composite oxide, the toner is likely to be positively charged by influence of the MgO which is likely to have a strongly positive charge, as instructed in "Relation of Electronegativity" (see *Nippon Gazo Gakkai shi* or "Journal of the Imaging Society of Japan" Vol. 39, No. 3 at page 259).

Forsterite and steatite respectively have an extremely weak adhesive force to metals. Therefore, when the members in a developing device are composed of metals, forsterite and steatite can prevent a toner from adhering on the metals. When a metal roller is used, effects of preventing toner filming and improving toner reset-ability can be expected. When a metal blade is used, toner filming prevention effect can be expected, similarly to the above.

Further, to avoid quality variation caused by change in residue of impurities, it is more preferable that the forsterite and the steatite do not to contain $SiO_2$ and MgO that are unreactive thereto.

A toner base that can be used in the embodiment of the present invention generally contains a binder resin, a colorant and other additives. For example, toner bases produced by the following four methods can be used. In the first method, a colorant, a charge controlling agent, a releasing agent and the like are fused, mixed and uniformly dispersed in a thermoplastic resin that will be a binder resin component to prepare a composition and the composition is then pulverized and classified to thereby obtain a toner base. In the second method, a colorant, a charge controlling agent, a releasing agent and the like are dissolved or suspended in a polymerizable monomer that is a binder resin raw material to prepare a dissolves solution or a suspension, a polymerization initiator is added thereto, the solution or the suspension is then dispersed in a water dispersion medium containing a dispersion stabilizer and heated to a predetermined temperature to initiate a suspension polymerization reaction, and upon completion of the polymerization, the solution or the suspension is filtered, washed, dehydrated and dried to thereby obtain a toner base. In the third method, a primary particle of a binder resin containing a polar group that is obtained by emulsion polymerization is flocculated by adding a colorant and a charge controlling agent thereto to prepare a secondary particle and the primary and secondary particles are stirred at a temperature higher than the glass transition temperature of the binder resin to associate these particles and the associated particles are filtered and dried to thereby obtain a toner base. In the fourth method, a hydrophilic group containing resin is used as a binder resin, a colorant and the like are added to the resin and then dissolved in an organic solvent, the resin is neutralized to reverse the phase of the resin, and the resin is then dried to thereby a colored particle, i.e., a toner base produced by phase reversal emulsion method.

In the embodiment of the present invention, a toner prepared by pulverization method is described, however, the toner used in the embodiment of the present invention is not particularly limited to the disclosed toner.

(Binder Resin)

The type of the binder resin used in a toner is not particularly limited and may be suitably selected from binder resins known in the area of full-color toner, for example, polyester resins, (meth)acrylic resins, styrene-(meth)acrylate copolymer resins, epoxy resins and cyclic olefin resins (such as TOPAS-COC, manufactured by Ticona Co.). From the perspective of stress resistance of the toner in a developing device, it is preferable to use polyester resins.

A polyester preferably used in the embodiment is a polyester resin that can be obtained by subjecting a polyvalent alcohol component and a polyvalent carboxylic acid component to a polycondensation reaction.

Among polyvalent alcohol components, examples of divalent alcohol components include bisphenol A alkylene oxide adducts such as polyoxypropylene (2,2)-2,2-bis(4-hydroxyphenyl) propane, polyoxypropylene (3,3)-2,2-bis(4-hydroxyphenyl) propane and polyoxyethylene (2,0)-2,2-bis(4-hydroxyphenyl) propane; ethylene glycol, diethylene glycol, triethylene glycol, 1,2-propylene glycol, 1,3-propylene glycol, 1,4-butandiol, neopentyl glycol, 1,4-butenediol, 1,5-pentane diol, 1,6-hexanediol, 1,4-cyclohexanedimethanol, dipropylene glycol, polyethylene glycol, polytetramethylene glycol, bisphenol A and hydrogenated bisphenol A.

Examples of trivalent or more alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxymethylbenzene.

Examples of divalent carboxylic acid components among polyvalent carboxylic acid components include maleic acids, fumaric acids, citraconic acids, itaconic acids, glutaconic acids, phthalic acids, isophthalic acids, terephthalic acids, cyclohexane dicarboxylic acids, succinic acids, adipic acids, sebacic acids, azelaic acids, malonic acids, n-dodecenylsuccinic acids, isodedecenylsuccinic acids, n-dodecenylsuccinic acids, isododecylsuccinic acids, n-octenylsuccinic acids, isooctenylsuccinic acids, n-octylsuccinic acids, isooctylsuccinic acids, and anhydrides or lower alkyl esters of these acids.

Examples of trivalent or more carboxylic acid components include 1,2,4-benzene tricarboxylic acid (trimellitic acid), 1,2,5-benzene tricarboxylic acid, 2,5,7-naphthalene tricarboxylic acid, 1,2,4-naphthalene tricarboxylic acid, 1,2,4-butanetricarboxylic acid, 1,2,5-hexanetricarboxylic acid, 1,3-dicarboxyl-2-methyl-2-methylenecarboxy propane, 1,2,4-cyclohexanetricarboxylic acid, tetra(methylene carboxyl) methane, 1,2,7,8-octanetetracarboxylic acid, 1,2,7,8-octanetetracarboxylic acid, pyromellitic acids, empol trimer acids and anhydrides or lower alkyl esters of these acids.

For the polyester resin used in the embodiment, it is also possible to use a resin that can be obtained by subjecting a polyester resin raw material monomer, a vinyl resin raw material monomer and a monomer mixture that is reactive to both of the raw material monomer resins to a polycondensation reaction for obtaining a polyester resin along with a radical polymerization reaction for obtaining a vinyl resin in a same vessel (hereinafter, referred to as vinyl polyester resin). Note that the monomer that is reactive to both of the raw material monomer resins is a monomer that can be used for both of the reactions of polycondensation reaction and radical polymerization reaction. Specifically, the monomer is a monomer having a carboxy group that can be reacted by a polycondensation reaction and a vinyl group that can be reacted by a radical polymerization reaction. Examples thereof include fumaric acids, maleic acids, acrylic acids and methacrylic acids.

Examples of polyester resin raw material monomers include the above-noted polyvalent alcohol components and polyvalent carboxylic acid components.

Examples of vinyl resin raw material monomers include styrenes or styrene derivatives such as methylstyrenes, m-methylstyrenes, p-methylstyrenes, α-methylstyrenes, p-ethylstyrenes, 2,4-dimethylstyrenes, p-tert-butylstyrenes and p-chlorostyrenes; ethylene-unsaturated monoolefines such as ethylenes, propylenes, butylenes and isobutylenes; methacrylic acid alkyl esters such as methyl methacrylates, n-propyl methacrylates, isopropyl methacrylates, n-butyl methacrylates, isobutyl methacrylates, t-butyl methacrylates, n-pentyl methacrylates, isopentyl methacrylates, neopentyl methacrylates, 3-(methyl)butyl methacrylates, hexyl methacrylates, octyl methacrylates, nonyl methacrylates, decyl methacrylates and undecyl methacrylates; acrylic acid alkyl esters such as methyl acrylates, n-propyl acrylates, isopropyl acrylates, n-butyl acrylates, isobutyl acrylates, t-butyl acrylates, n-pentyl acrylates, isopentyl acrylates, neopentyl acrylates, 3-(methyl) butyl acrylates, hexyl acrylates, octyl acrylates, nonyl acrylates, decyl acrylates, undecyl acrylates and dodecyl acrylates; unsaturated carboxylic acids such as acrylic acids, methacrylic acids, itaconic acids and maleic acids; acrylonitrile, maleic acid esters, itaconic acid esters, vinyl chlorides, vinyl acetates, vinyl benzoates, vinylmethylethylketone, vinylhexylketone, vinylmethylether, vinylethylether and vinylisobutylether.

Examples of the polymerization initiator used when the vinyl resin raw material monomer is polymerized include azo-based or diazo-based polymerization initiators such as 2,2'-azobis (2,4-dimethylvaleronitril), 2,2'-azobisisobutylonitril, 1,1'-azobis (cyclohexane-1-carbonitrile) and 2,2'-azobis-4-methoxy-2,4-dimethylvaleronitrile; and peroxide polymerization initiators such as benzoyl peroxides, dicumyl peroxides, methylethylketone peroxides, isopropyl peroxy carbonates and lauroyl peroxides.

For the binder resin, the above-noted various polyester resins are preferably used. Of these, it is more preferable to use a primary binder resin and a secondary binder resin as described below from the perspective of improving separatability and anti-offset property as a toner used in oil-less fixing process.

A more preferable primary binder resin is a polyester resin that can be obtained by polycondensing the above-noted polyvalent alcohol component with the above-noted polyvalent carboxylic acid component, in particular, is a polyester resin that can be obtained by using a bisphenol A alkylene oxide adduct as the polyvalent alcohol component and using a terephthalic acid and a fumaric acid as the polyvalent carboxylic acid component.

A more preferable secondary binder resin is a vinyl polyester resin, in particular, is a vinyl polyester resin that can be obtained by using a bisphenol A alkylene oxide adduct, a terephthalic acid, a trimellitic acid and a succinic acid as the polyester resin raw material monomer, using styrene and butyl acrylate as the vinyl resin raw material monomer and using a fumaric acid as a monomer that is reactive to the polyester resin raw material monomer and the vinyl resin raw material monomer.

In the embodiment of the present invention, it is preferable that a hydrocarbon wax is internally added at the time of synthesizing the primary binder resin. To internally add a hydrocarbon wax in the primary binder resin beforehand, it is necessary to synthesize the primary binder resin in a state where a hydrocarbon wax has been added in a monomer used to synthesize the primary binder resin. For example, the polyvalent alcohol component and the polyvalent carboxylic acid component are subjected to a polycondensation reaction in a state where a hydrocarbon wax has been added to the carboxylic acid monomer and the alcohol monomer constituting a polyester resin as the primary binder resin. When the primary binder resin is a vinyl polyester resin, a hydrocarbon wax is added to a polyester resin raw material monomer and a vinyl resin raw material monomer is delivered by drops thereinto while stirring and heating the polyester resin raw material monomer and the hydrocarbon wax, thereby carrying out a polycondensation reaction and a radical polymerization reaction.

(Wax)

In general, the lower the polarity of a wax, the more excellent in releasing property of the toner with a fixing member or a fixing roller. A wax used in the embodiment of the present invention is a hydrocarbon wax having a low polarity.

(Hydrocarbon Wax)

A hydrocarbon wax is a wax that is composed of only carbon atoms and hydrogen atoms and does not contain ester groups, alcohol groups, amide groups and the like. Specific examples of the hydrocarbon wax include polyolefin waxes such as copolymers of polyethylene, polypropylene and ethylene with propylene; petroleum waxes such as paraffin waxes and microcrystalline waxes; and synthetic waxes such as Fisher-Tropsh waxes. Among these waxes, preferred hydrocarbon waxes in the embodiment of the present invention are polyethylene waxes, paraffin waxes and Fisher-Tropsh waxes. More preferable waxes are polyethylene waxes and paraffin waxes.

(Melting Point of Wax)

A melting point of a wax in the embodiment of the present invention is an endothermic peak of the wax measured by a differential scanning calorimeter in temperature rise. The melting point of the wax is preferably within a range of 70° C. to 90° C. When a wax having a melting point higher than 90° C. is used, the wax is insufficiently fused in a fixing process, sufficient separatability of the toner with a fixing member cannot be ensured. When a wax having a melting point lower than 70° C., it may cause a problem with storage stability, for example, toner particles are fusion-bonded each other in high-temperature and high humidity environments. To obtain sufficient fixing separatability of a toner at low temperatures, the melting point of the wax is more preferably 70° C. to 85° C. and still more preferably 70° C. to 80° C.

(Endothermic Peak of Wax)

A half-value width of an endothermic peak of the wax, in temperature rise, measured by use of a differential scanning calorimeter is preferably 7° C. or less. Since the melting point of the wax in the embodiment of the present invention is relatively low, the endothermic peak range is wide. In other words, a wax that could be fusion-bonded at low temperatures adversely affects storage stability of the toner.

(Wax Content)

The content of the wax in the toner in the embodiment of the present invention is typically 2% by mass to 10% by mass, preferably 3% by mass to 8% by mass, and still more preferably 3% by mass to 6% by mass. When the wax content is less than 2% by mass, the amount of wax exuded in between a fused toner and a fixing member is insufficient in a fixing process, the adhesive force applied in between the fused toner and the fixing member is not reduced, and thus a recording material will not separate from the fixing member. In contrast, when the wax content is more than 10% by mass, the amount of wax exposed on the toner surface is increased and the flowability of toner particles is degraded, resulting in reduction in transfer rate of the toner from a developing device to a photoconductor and from the photoconductor to a recording material. Therefore, not only quality of images is significantly degraded but also the wax adhering on the toner surface breaks away from the toner surface, causing contamination of the developing members and the photoconductor.

(Content Ratio of Primary Binder Resin and Secondary Binder Resin)

The content ratio of the primary binder resin (including the mass of internally added waxes) to the secondary binder resin is typically, based on mass ratio, 20/80 to 45/55, and more preferably 30/70 to 40/60. When the content ratio of the primary binder resin is excessively low, the separatability and the high-temperature anti-offset property of the toner are degraded to cause problems. When the content ratio of the primary binder resin is excessively high, the glossiness and the heat-resistance/storage stability of the toner are degraded.

More preferably, the softening point of a binder resin composed of the primary binder resin and the secondary binder resin that are used at the mass ratio stated above is preferably 100° C. to 130° C. and still more preferably 105° C. to 130° C. In the embodiment of the present invention, the softening point of the binder resin composed of the primary binder resin with a wax internally added therein and the secondary binder resin is preferably within the above noted range.

The acid value of the primary binder resin with a wax internally added therein is preferably 5 KOHmg/g to 50 KOHmg/g and more preferably 10 KOHmg/g to 40 KOHmg/g. The acid value of the secondary binder resin is preferably 0 KOHmg/g to 10 KOHmg/g and more preferably 1 KOH mg/g to 5 KOHmg/g. Particularly when a polyester resin is used, the dispersibility of various colorants and the like can be improved and a toner having a sufficient amount of charge can be produced by using a resin having the above-noted acid value.

The primary binder resin preferably contains components insoluble in tetrahydrofuran, from the perspective of heat-resistance offset property. The content of the tetrahydrofuran-insoluble components in the primary binder resin with a wax internally added therein is preferably 0.1% by mass to 15% by mass, more preferably 0.2% by mass to 10% by mass, and still more preferably 0.3% by mass to 5% by mass.

(Colorant)

For colorants used in the embodiment of the present invention, known pigments and dyes used as colorants for full-color toners can be used. Examples of the colorants include carbon black, aniline blue, chalco oil blue, chrome yellow, ultramarine blue, Dupont Oil Red, Quinoline Yellow, methylene blue chloride, copper phthalocyanine, malachite green oxalate, Lamp Black, Rose Bengale, C.I. Pigment•Red 48:1, C.I. Pigment•Red 122, C.I. Pigment•Red 57:1, C.I. Pigment•Red 184, C.I. Pigment•Yellow 97, C.I. Pigment•Yellow 12, C.I. Pigment•Yellow 17, C.I. Pigment•Yellow 74, C.I. Solvent•Yellow 162, C.I. Pigment•Yellow 180, C.I. Pigment•Yellow 185, C.I. Pigment•Blue 15:1 and C.I. Pigment•Blue 15:3. The content of the colorants in the toner particles is preferably 2 parts by mass to 15 parts by mass to 100 parts by mass of the total content of the binder resins. From the perspective of dispersibility of colorants, the colorants are preferably used in a form of a masterbatch in which they are dispersed in a mixture binder resin in which the primary binder resin and the secondary binder resin to be used are dispersed. The additive amount of the colorants to the masterbatch is preferably adjusted so that the amount of the colorants contained in the masterbatch is within the above-noted range. The content of the colorants in the masterbatch is preferably 20% by mass to 40% by mass.

(Charge Controlling Agent)

In the toner in the embodiment of the present invention, known charge controlling agents that have been conventionally used for full-color toners may be used. Examples of such charge controlling agents include nigrosine dyes, triphenylmethane dyes, chrome-containing metal complex dyes, molybdenum acid chelate pigments, Rhodamine dyes, alkoxy amines, quaternary ammonium salts (including fluorine-modified quaternary ammonium salts), alkyl amides, phosphorous simple substance or phosphorous compounds, tungsten simple substance or tungsten compounds, fluorine activators, salicylic acid metal salts and metals salts of salicylic acid derivatives. Specific examples of the charge controlling agents include BONTRON 03 that is a nigrosine dye, BONTRON P-51 that is a quaternary ammonium salt, BONTRON S-34 that is a metal-containing azo dye, E-82 that is an oxynaphthoic acid metal complex and E-89 that is a phenol condensate (all manufactured by Orient Chemical Industries, Ltd.); TP-302 and TP-415 that are respectively a quaternary ammonium salt molybdenum complex (all manufactured by Hodogaya Chemical Co.); COPY CHARGE PSY VP2038 that is a quaternary ammonium salt, COPY BLUE PR that is a triphenyl methane derivative, COPY CHARGE NEG VP2036 and COPY CHARGE NX VP434 that are respectively a quaternary ammonium salt (all manufactured by Hochst Corporation); LRA-901 and LR-147 that is a boron complex (all manufactured by Japan Carlit Co., Ltd.); copper phthalocyanine, perylene, quinacridone, azo pigments and polymer compounds having a functional group such as sulfonic acid group, carboxyl group or quaternary ammonium salt. Of these, materials that control the toner to have a negative-electrode are preferably used.

The use amount of the charge controlling agent is determined depending on the type of the binder resins, presence or absence of additives to be used in accordance with necessity and the toner production method including dispersing method and cannot be uniformly specified, however, it is preferably 0.1 parts by mass to 10 parts by mass to 100 parts by mass of the binder resins. Preferably, the charge controlling agent is used in a range of 0.2 parts by mass to 5 parts by mass. When the content of the charge controlling agent is more than 10 parts by mass, the effect of the charge controlling agent is reduced because of excessive charge ability of the toner. Due to reduction of the effect of the charge controlling agent, a electrostatic suction force between the toner and a developing roller is increased to cause degradations in toner flowability and image density.

(External Additive)

In the embodiment of the present invention, for external additives assisting in flowability, developing property, charge ability, durability and the like of the toner, besides the above noted composite oxides, other inorganic fine particles can be used. In particular, it is preferable to use a composite oxide together with an inorganic fine particle. Specific examples of the inorganic fine particle include silicon oxides, zinc oxides, tin oxides, silicate sands, titanium oxides, clays, mica, wallastonite, silious earth, chrome oxides, cerium oxides, colcothar, antimony trioxides, magnesium oxides, aluminum oxides, zirconium oxides, barium sulfates, barium carbonates, calcium carbonates, silicon carbides and silicon nitrides. For the total amount of the external additives in the embodiment of the present invention, it is preferably 1.0 part by mass to 5.0 parts by mass to the total amount of the toner base. When the total amount of the external additives is more than 5.0 parts by mass, toner fogging occurs and the developing property and separatability of the toner in a fixing process will be degraded. When the total amount of the external additives is less than 1.0 part by mass, the flowability, transfer property, durability and heat-resistance/storage stability will be degraded.

(Toner Production Method)

The toner in the embodiment of the present invention can be obtained by mixing a primary binder resin with the hydrocarbon wax internally added therein, a secondary binder resin and a colorant by a conventional method, kneading and pulverizing the mixture to produce a powder and classifying the powder, selecting toner particles having desired particle diameters (colored resin particles) among the powder, finally, mixing the selected toner particles with external additives. The average particle diameter of toner particles is typically 4 μm to 10 μm and more preferably 5 μm to 10 μm.

(Configuration of Developing Device)

FIG. 1 is a block diagram exemplarily showing an embodiment of the developing device of the present invention.

Hereinafter, the developing device used in the embodiment of the present invention will be described. The developing device has a developing roller and a controlling member, in which the developing roller is composed of a metal and the surface of the controlling member is composed of an elastic material, however, the configuration of the developing device of the present invention is not limited thereto.

With reference to FIG. 1, a developing device 12 configured to visualize an image into a latent electrostatic image on a photoconductor 11 rotating in a direction indicated by an arrow A is equipped with, when briefly described, a developing roller 13, a toner supplying roller 14, a toner layer thickness controlling blade 15, a first toner holding section 16, second toner holding sections 17 and toner conveying shafts 18.

The developing roller 13 is subjected to a blast surface treatment with a glass bead such that the surface thereof has a predetermined surface roughness (fine convexoconcaves or irregularities). Particularly when the developing roller 13 is composed of an aluminum material, it is preferable in that the surface treatment is easy. Further, since the surface roughness of the developing roller 13 composed of an aluminum material can be easily adjusted by controlling the pressure used when the developing surface is blasted with a glass bead, the surface roughness (Ra) can be set within a range of 0.2 μm to 0.5 μm and a toner in a necessary amount can be held on the surface of the developing roller 13. For the developing roller 13, similarly to aluminum, a resin can also be used. To the developing roller 13, a developing bias is applied to form an electric filed in between the developing device 13 and the photoconductor 11. The developing roller 13 rotates in a direction indicated by an arrow B in the FIGURE and coveys the toner held on the surface thereof to an opposite position to the toner layer thickness controlling blade 15 serving as a controlling member, which will be described below, and the photoconductor 11.

The toner supplying roller 14 rotates in a direction indicated by an arrow C in the FIGURE while making contact with the surface of the developing roller 13 or maintaining a slight space therebetween. The toner supplying roller 14 also makes contact with a first toner stored in the first toner holding section 16 and supplies the first toner to the developing roller 13.

The toner layer thickness controlling blade 15 serving as a controlling member is provided at a lower position than the position at which the toner supplying roller 14 makes contact with the developing roller 13. To make a conveyance amount of the toner to be set within a certain definite range and to make it behave, a second toner to be described hereinafter that is different from the first toner which has been stored in the second toner holding sections 17 is preliminarily and uniformly applied to the surface of the toner layer thickness controlling blade 15 before shipping. The toner layer thickness controlling blade 15 is structured by laminating an elastic material on a surface of a metal plate spring material such as SUS and phosphorous bronze. The free end of the toner layer thickness controlling blade 15 is made to contact with the surface of the developing roller 13 at a suppress strength of 10 N/m to 40 N/m. The toner layer thickness controlling blade 15 makes the toner passing through under the suppression pressure into a thin layer and applies a charge by effect of fictional charge. Further, to help frictional charge, a control bias having a value that is offset to the developing bias in the same direction as the charge polarity of the toner is applied to the toner layer thickness controlling blade 15.

A rubber elastic material constituting the elastic material used for the toner layer thickness controlling blade 15 is not particularly limited. Examples thereof include styrene-butadiene copolymer rubbers, acrylonitrile-butadiene copolymer rubbers, acryl rubbers, epichlorohydrin rubbers, urethane rubbers, silicon rubbers and a blend rubber containing two or more of these rubber elastic materials. Of these rubber elastic materials, a blend rubber of an epichlorohydrin rubber with an acrylonitrile-butadiene copolymer rubber is preferably used.

The toner conveying shafts 18 are provided in the second toner holding sections 17 where a large amount of the first toner is stored. To convey a toner to the first toner holding section 16 that is used to supply the toner to the toner supplying roller 14, the toner conveying shafts 18 respectively rotate indicated by arrows D in the FIGURE in the second toner holding sections 17.

(Toner Conveyance Amount M and Initial Toner Conveyance Amount Ms)

A weight per unit area ($g/m^2$) measured by suctioning the amount of a toner within an area of 1 cm by 7 cm in size, i.e., 7 $cm^2$ by means of a suction pump is defined as a toner conveyance amount M. A process cartridge including a developing device that has been filled with a toner is mounted in the main body of an image forming apparatus, the electric power source is turned off and then turned on, and a toner conveyance amount measured after the condition of the image forming apparatus is stabilized is defined as an initial toner conveyance amount Ms ($g/m^2$). When a developing device mounted in an image forming apparatus is a developing device that can keep a toner conveyance amount M, when an initial toner conveyance amount of a toner on the developing roller is defined as Ms, within a range expressed as $0.85\ Ms<M<1.35\ Ms$ and serves out its lifetime, it is possible not only to prevent occurrence of background smear in non-image formed portions, toner bleed, toner scattering and streak lines on the developing roller but also to make nonuniformity of image-formed portions inconspicuous.

Further, the initial toner conveyance amount Ms itself is not particularly limited, however, it is preferably 3.5 $g/m^2$ to 6.5 $g/m^2$.

(Configuration of Charging Member in Photoconductor)

In the embodiment of the present invention, a charging member used in a photoconductor preferably has the following configuration, however, the configuration is not particularly limited.

The charging member used in the embodiment of the present invention is provided with a cored bar, a conductive layer formed on the cored bar and a surface layer coating the conductive layer and is formed in a cylindrical shape in whole. In the charging member, a voltage applied to the cored bar from the electric power source is then applied to a photoconductor via the conductive layer and the surface layer to charge the photoconductor surface.

The cored bar of the charging member is placed in parallel to the axis of the photoconductor along the longitudinal direction of the photoconductor, the entire body of the charging member is pressed against the photoconductor with a predetermined suppress strength. With this configuration, a part of the photoconductor surface can make contact with a part of the charging member surface along the longitudinal directions of both of the photoconductor and the charging member and a contact nip can be formed with a given width. The photoconductor is driven to rotate by a driving unit, and the charging member is configured to be driven to rotate along with the rotation of the photoconductor.

The photoconductor is charged by the electric power source via the neighborhood of the contact nip. The charging member surface makes contact over a photoconductor surface area to be charged (corresponding to the length of the charging member), thereby the photoconductor surface can be uniformly charged.

The conductive layer of the charging member is composed of a nonmetal, and to stabilize the contact condition with the photoconductor, a material of a low hardness can be preferably used. For example, resins such as polyurethane, polyether and polyvinyl alcohol and rubbers such as hydrin rubbers, EPDMs and NBRs are used. For materials of the conductive material, carbon black, graphites, titanium oxides and zinc oxides are exemplified.

For the surface layer, a material having a middle resistance value of $10^2\Omega$ to $10^{10}\Omega$ is used.

For example, nylon, polyamide, polyimide, polyurethane, polyester, silicon, TEFLON (registered), polyacetylene, polypyrrole, polytheophene, polycarbonate and polyvinyl and the like can be used. In particular, to increase a contact angle with water, it is preferable to use a fluorine-based resin.

Examples of the fluorine-based resin include polyvinylidene fluorides, polyethylene fluorides, vinylidene fluoride-tetrafluoroethylene copolymers and vinylidene fluoride-tetrafluoroethylene-hexafluoropropylene copolymers.

In order to make the surface layer have a middle resistance value, conductive materials such as carbon black, graphites, titanium oxides, zinc oxides, tin oxides and iron oxides may be added in a suitable amount to the surface layer.

EXAMPLE 1

Hereinafter, the embodiment of the present invention will be further described in detail referring to specific Examples and Comparative Examples, however, the present invention is not limited to the disclosed Examples.

(Preparation of Primary Binder Resin)

As a vinyl monomer, 600 g of styrene, 110 g of butyl acrylate, 30 g of acrylic acid and as a polymerization initiator, 30 g of dicumyl peroxide were placed in a dripping funnel. In a 5-liter four-opening flask equipped with a thermometer, a stainless-steel stirrer, a falling condenser and a nitrogen inlet tube, as polyols among polyester monomers, 1,230 g of polyoxypropylene (2.2)-2,2-bis(4-hydroxyphenyl) propane, 290 g of polyoxyethylene (2.2)-2,2-bis(4-hydroxyphenyl) propane, 250 g of isododecenyl succinic anhydride, 310 g of terephthalic acid, 180 g of benzene-1,2,4-tricarboxylic anhydride, 7 g of dibutyltin oxide as an esterified catalyst and 340 g (11.0 parts by mass to 100 parts by mass of the monomer) of paraffin wax as a wax (melting point: 73.3° C., half-value width of an endothermic peak in temperature rise measured by a differential scanning calorimeter: 4° C.) were put and the components of the polyols, the esterified catalyst and the wax in the flask were heated in a mantle heater under a nitrogen atmosphere and stirred at 160° C. With stirring the mixed components at 160° C., the mixture of the vinyl monomer resins and the polymerization initiator was delivered by drops through the dripping funnel into the mixed components for 1 hour. The mixture was addition-polymerized and aged for 2 hours while maintaining the temperature at 160° C. and thereafter, the temperature was increased to 230° C. to subject the mixture to a polycondensation reaction. The polymerization degree of the mixture was tracked based on the softening point of the mixture measured using a constant load extruder narrow tube type rheometer and the polycondensation reaction was finished when the softening point of the mixture reached a predetermined softening point, thereby obtaining a primary binder resin. The primary binder resin had a softening point of 130° C.

(Preparation of Secondary Binder Resin)

As polyols, 2,210 g of polyoxypropylene (2.2)-2,2-bis (4-hydroxyphenyl) propane, 850 g of terephthalic acid, 120 g of benzene-1,2,4-tricarboxylic anhydride and as an esterified catalyst, 0.5 g of dibutyltin oxide were put in a 5-litter five-opening flask equipped with a thermometer, a stainless-steal stirrer, a falling condenser and a nitrogen inlet tube and the components were heated to 230° C. in a mantle heater under a nitrogen atmosphere to thereby subject the mixture to a polycondensation reaction. The polymerization degree of the mixture was tracked based on the softening point of the mixture measured using a constant load extruder narrow tube type rheometer and the polycondensation reaction was finished when the softening point of the mixture reached a predetermined softening point, thereby obtaining a secondary binder resin. The secondary binder resin had a softening point of 115° C.

(Preparation of Toner Particle)

A masterbatch containing 4 parts by mass of C.I Pigment Red 57-1 to 100 parts by mass of a binder resin composed of the primary binder resin and the secondary binder resin (including the mass of the internally added wax) was sufficiently mixed using a HENSCHEL MIXER, and the masterbatch was fused and kneaded using a biaxial extrusion kneader (PCM-30, manufactured by IKEGAI LTD.) that had been remodeled such that the discharging unit was removed therefrom. The obtained kneaded material was rolled out in a layer of 2 mm in thickness using a cooling press roller, cooled using a cooling belt and then coarsely crushed using a feather mill. Thereafter, the coarsely crushed material was then pulverized using a mechanical pulverizer (KTM, manufactured by KAWASAKI HEAVY INDUSTRIES, LTD.) so as to have an average particle diameter of 10 μm to 12 μm, and the material further pulverized while coarsely classifying the material using a jet pulverizer (IDS, manufactured by Nippon Pneumatic Manufacturing Co., Ltd.). Thereafter, the coarsely classified material was further classified to obtain a fine powder using a rotor classifier (Teeplex-type classifier, 100 ATP, manufactured by Hosokawa micron Co., Ltd.) to thereby obtain a colored resin particle T1. The colored resin particle T1 had a particle diameter of 8.2 μm.

To 100 parts by mass of the colored resin particle T1, 0.4 parts by mass of forsterite (primary inorganic fine particle), 1 part by mass of SILICA RX200 (secondary inorganic fine particle) and 1 part by mass of SILICA RX50 (third inorganic fine particle) were added, these particles were mixed using a HENSCHEL MIXER at a circumferential speed of 45 m/sec for 60 seconds to thereby obtain a magenta toner T1*a*. The magenta toner T1*a* was to be used as the above-noted first toner.

Further, a magenta toner T1*b* was obtained by subjecting to mixing treatments in the same manner as described above, except that the additive amount of forsterite was changed to 0.8 parts by mass (primary inorganic fine particle). The magenta toner T1*b* was to be used as the above-noted second toner.

EXAMPLES 2 TO 10 AND COMPARATIVE EXAMPLES 1 TO 6

Magenta toners T2*a* to T16*a* and T2*b* to T16*b* of Examples 2 to 10 and Comparative Examples 1 to 6 were obtained in the same manner as in Example 1, except that the type of external additives and the used amount thereof shown in Tables 1-A and 1-B were employed, respectively. The magenta toner T2*a* to T16*a* were to be used as the above-noted first toner, and the magenta toner T2*b* to T16*b* were to be used as the above-noted second toner.

TABLE 1-A

| | | Formulation of External Additive | | | | | | | | | |
|---|---|---|---|---|---|---|---|---|---|---|---|
| | | Primary inorganic fine particle | | | | | | Secondary inorganic fine particle | | Third inorganic fine particle | |
| | Magenta toner | Type of external additive | Primary particle diameter (μm) | Relative dielectric constant | Electric resistance (Ω · cm) | Added amount (part by mass) | b/a | Type of external additive | Added amount (part by mass) | Type of external additive | Added amount (part by mass) |
| Ex. 1 | T1a | $Mg_2SiO_4$ | 0.08 | 6 | 2.00E+14 | 0.40 | 2.0 | RX200 | 1 | RX50 | 1 |
| | T1b | $Mg_2SiO_4$ | 0.08 | 6 | 2.00E+14 | 0.80 | | RX200 | 1 | RX50 | 1 |
| Ex. 2 | T2a | $Mg_2SiO_4$ | 0.08 | 6 | 2.00E+14 | 0.60 | 1.7 | RX200 | 1 | RX50 | 1 |
| | T2b | $Mg_2SiO_4$ | 0.08 | 6 | 2.00E+14 | 1.00 | | RX200 | 1 | RX50 | 1 |
| Ex. 3 | T3a | $Mg_2SiO_4$ | 0.08 | 6 | 2.00E+14 | 0.20 | 2.8 | RX200 | 1 | RX50 | 1 |
| | T3b | $Mg_2SiO_4$ | 0.08 | 6 | 2.00E+14 | 0.55 | | RX200 | 1 | RX50 | 1 |
| Ex. 4 | T4a | $Mg_2SiO_4$ | 0.08 | 6 | 2.00E+14 | 1.25 | 1.2 | RX200 | 1 | RX50 | 1 |
| | T4b | $Mg_2SiO_4$ | 0.08 | 6 | 2.00E+14 | 1.50 | | RX200 | 1 | RX50 | 1 |
| Ex. 5 | T5a | $Mg_2SiO_4$ | 0.08 | 6 | 2.00E+14 | 0.10 | 2.5 | RX200 | 1 | RX50 | 1 |
| | T5b | $Mg_2SiO_4$ | 0.08 | 6 | 2.00E+14 | 0.25 | | RX200 | 1 | RX50 | 1 |
| Ex. 6 | T6a | $Mg_2SiO_4$ | 0.98 | 6 | 2.00E+14 | 0.40 | 2.0 | RX200 | 1 | RX50 | 1 |
| | T6b | $Mg_2SiO_4$ | 0.98 | 6 | 2.00E+14 | 0.80 | | RX200 | 1 | RX50 | 1 |
| Ex. 7 | T7a | $Mg_2SiO_4$ | 0.22 | 6 | 2.00E+14 | 0.40 | 2.0 | RX200 | 1 | RX50 | 1 |
| | T7b | $Mg_2SiO_4$ | 0.22 | 6 | 2.00E+14 | 0.80 | | RX200 | 1 | RX50 | 1 |
| Ex. 8 | T8a | $MgSiO_3$ | 0.20 | 6.3 | 2.40E+14 | 0.40 | 2.0 | RX200 | 1 | RX50 | 1 |
| | T8b | $MgSiO_3$ | 0.20 | 6.3 | 2.40E+14 | 0.80 | | RX200 | 1 | RX50 | 1 |
| Ex. 9 | T9a | $Mg_2SiO_4$ | 0.08 | 6 | 2.00E+14 | 0.40 | — | RX200 | 1 | RX50 | 1 |
| | T9b | $Mg_2SiO_4$ | 0.08 | 6 | 2.00E+14 | 0.40 | | RX200 | 0.5 | RX50 | 1 |
| Ex. 10 | T10a | $Mg_2SiO_4$ | 0.08 | 6 | 2.00E+14 | 0.40 | — | RX200 | 1 | RX50 | 1 |
| | T10b | $Mg_2SiO_4$ | 0.08 | 6 | 2.00E+14 | 0.40 | | RX200 | 1 | RX50 | 1.5 |

TABLE 1-B

| | | Formulation of External Additive | | | | | | | | | |
|---|---|---|---|---|---|---|---|---|---|---|---|
| | | Primary inorganic fine particle | | | | | | Secondary inorganic fine particle | | Third inorganic fine particle | |
| | Magenta toner | Type of external additive | Primary particle diameter (μm) | Relative dielectric constant | Electric resistance (Ω · cm) | Added amount (part by mass) | b/a | Type of external additive | Added amount (part by mass) | Type of external additive | Added amount (part by mass) |
| Compara. | T11a | $Mg_2SiO_4$ | 0.08 | 6 | 2.00E+14 | 0.05 | 2.0 | RX200 | 1 | RX50 | 1 |
| Ex. 1 | T11b | $Mg_2SiO_4$ | 0.08 | 6 | 2.00E+14 | 0.10 | | RX200 | 1 | RX50 | 1 |
| Compara. | T12a | $Mg_2SiO_4$ | 0.08 | 6 | 2.00E+14 | 0.90 | 2.0 | RX200 | 1 | RX50 | 1 |
| Ex. 2 | T12b | $Mg_2SiO_4$ | 0.08 | 6 | 2.00E+14 | 1.80 | | RX200 | 1 | RX50 | 1 |
| Compara. | T13a | $Mg_2SiO_4$ | 0.08 | 6 | 2.00E+14 | 1.50 | 0.7 | RX200 | 1 | RX50 | 1 |
| Ex. 3 | T13b | $Mg_2SiO_4$ | 0.08 | 6 | 2.00E+14 | 1.00 | | RX200 | 1 | RX50 | 1 |
| Compara. | T14a | $Mg_2SiO_4$ | 0.08 | 6 | 2.00E+14 | 0.60 | 3.3 | RX200 | 1 | RX50 | 1 |
| Ex. 4 | T14b | $Mg_2SiO_4$ | 0.08 | 6 | 2.00E+14 | 2.00 | | RX200 | 1 | RX50 | 1 |
| Compara. | T15a | $SrTiO_3$ | 0.10 | 330 | 3.70E+07 | 0.40 | 2.0 | RX200 | 1 | RX50 | 1 |
| Ex. 5 | T15b | $SrTiO_3$ | 0.10 | 330 | 3.70E+07 | 0.80 | | RX200 | 1 | RX50 | 1 |
| Compara. | T16a | $TiO_2$ | 0.20 | 48 | 4.00E+04 | 0.40 | 2.0 | RX200 | 1 | RX50 | 1 |
| Ex. 6 | T16b | $TiO_2$ | 0.20 | 48 | 4.00E+04 | 0.80 | | RX200 | 1 | RX50 | 1 |

(In Tables 1-A and 1-B, "TNa" (N is an integer) in the column of "Magenta toner" represents the above-noted first toner, "TNb" (N is an integer) in the column of "Magenta toner" represents the above-noted second toner; "b/a" in the column of "Primary inorganic fine particle" means a ratio of the additive amount of the primary inorganic fine particle in the magenta toner TNb (N is an integer) to the additive amount of the primary inorganic fine particle in the magenta toner TNa (N is an integer).)

Next, the evaluation method of the toners prepared in Examples 1 to 10 and Comparative Examples 1 to 6 will be explained.

(Toner Particle Diameter)

The method of measuring a particle size distribution of the prepared toner particle will be explained below. For a measurement device of a particle size distribution of a toner particle according to Coulter Counter method, COULTER COUNTER TA-II analyzer and COULTER MULTISIZER II analyzer (both manufactured by COULTER Co.) are exemplified. Hereinafter, the measurement method of a particle size distribution of a toner particle will be described. First, 0.1 mL to 5 mL of a surfactant (preferably, alkylbenzene sulfonate) serving as a dispersing agent was added to 100 mL to 150 mL of an electrolytic solution. Here, the electrolytic solution is a sodium chloride aqueous solution containing around 1% (weight/volume) of sodium chloride prepared by using primary sodium chloride. For example, ISOTON-II (manufactured by COULTER Co.) can be used. Here, the measurement sample (2 mg to 20 mg) was weighed based on the solid content was added to the electrolytic solution. The electrolytic solution with the sample suspended therein was subjected to a dispersion treatment for around 1 minute to 3 minutes using an ultrasonic dispersing device. From the electrolytic dispersion, the volume of the toner particle and the number of particles were measured by means of the analyzer, using a 100 μm aperture as an aperture. Based on the measured volume of the toner particle and the number of particles, the volume distribution and the number distribution of the toner particle were calculated. Based on the obtained volume distribution and the number distribution, the weight average particle diameter and the number average particle diameter of the toner can be determined. For channels, the following 13 channels were used. Specifically, a channel of 2.00 μm to less than 2.52 μm, a channel of 2.52 μm to less than 3.17 μm, a channel of 3.17 μm to less than 4.00 μm, a channel of 4.00 μm to less than 5.04, a channel of 5.04 μm to less than 6.35 μm, 6.35 μm to less than 8.00 μm, 8.00 μm to less than 10.08 μm, 10.08 μm to less than 12.70 μm, a channel of 12.70 μm to less than 16.00 μm, a channel of 16.00 μm to less than 20.20 μm, a channel of 20.20 μm to less than 25.40 μm, a channel of 25.40 μm to less than 32.00 μm and a channel of 32.00 μm to less than 40.30 μm were used, and toner particles having a particle diameter of 2.00 μm to less than 40.3 μm were used for the measurement.

(Softening Point)

Using a FLOWTESTER CFT-500 (manufactured by Shimadzu Corporation), the measurement sample (1.5 g) was weighed and measured under the conditions of temperature increase rate of 3.0° C./min, preheating time of 180 seconds, a load of 30 kg and a temperature range for measurement of 80° C. to 140° C. using a die of 1.0 mm in diameter and 1.0 mm in height, and a temperature at which a half of the sample eluted off was regarded as the softening point of the sample.

(Measurement of Particle Diameter of Inorganic Fine Particle)

The inorganic fine particle was resin-embedded to prepare a slice using a microtome and the sample was observed using a transmission electron microscope to determine the particle diameter.

(Measurement of Relative Dielectric Constant)

The relative dielectric constant of toner samples was determined as follows.

One gram of a measurement sample was pressurized with 7.5N for 30 seconds and then placed in a liquid measurement cell (5 mL liquid measurement cell Model-12964A). The liquid measurement cell was nipped with a pair of electrodes, and the relative dielectric constant of the measurement sample was measured using an IMPEDANCE ANALYZER Model-1260 (manufactured by Solar Toron Co.) at an alternating current (AC) frequency of 1 MHz with a voltage of 0.1V.

(Measurement of Volume Resistivity)

The volume resistivity value of toner samples was determined as follows.

Three grams of the prepared toner sample was nipped with a pair of electrodes equipped on a Super High Resistance Measurement Test Material Chamber TR42 (manufactured by Advantest Co.) such that a load of 1 kg/cm$^2$ was applied to the toner sample (figuring that a load (empty weight) as much as 6 kg was applied to a target sample with a diameter of 60 mm, the load (empty weight) was converted with the diameter 25 mm (ϕ) of the following electrodes), and a direct current (DC) of a voltage 500V was applied between the electrodes using a digital super high resistance/minute electric current detector R8340A to thereby determine the volume resistivity value of the toner sample.

Tables 1-A and 1-B show the evaluation results of the toners prepared in Examples 1 to 10 and Comparative Examples 1 to 6.

Next, for the toners prepared in Examples 1 to 10 and Comparative Examples 1 to 6, the state of each of the toners after actually used in an image forming apparatus, the state of peripheral areas of a developing roller attached in a developing device and the evaluation method for printed images will be explained.

(Method for Measuring Charged Amount Per Unit Mass)

A charged amount per unit mass of each of the toners is defined as a suction charge amount (μC/g) of the surface of the developing roller.

(Developing of Image Using IPSIO CX2500, Manufactured by Ricoh Company Ltd.)

The developing device was filled with 100 g of each of the toners and then placed in an image forming apparatus, IPSIO CX2500 (manufactured by Ricoh Company Ltd.), the power source was turned on and the developing device was removed from the image forming apparatus immediately after the condition of the image forming apparatus was stabilized.

A drive gear of the developing device was rotated in the forward direction, and the nip portion was shifted upward. Then, each of the toners within an area of 1 cm by 7 cm in size, i.e., 7 cm$^2$, on the developing roller surface was suctioned by means of a suction pump to thereby determine the charged amount (μC/g) per unit mass of the toner using an ELECTROMETER 6514/J (manufactured by KEITHLEY, Co.).

(Evaluation of Toner Using Image Forming Apparatus)

An image forming apparatus, IPSIO CX2500 manufactured by Ricoh Company Ltd. was used for the evaluation test.

In a developing device, the magenta T1*b*, as the second toner, was preliminarily applied over the surface (the toner conveyance side) of the toner layer thickness controlling blade serving as a controlling member. The developing device was filled with 100 g of the magenta toner T1*a* as the first toner. Subsequently, after 2,000 sheets of A4 size paper were continuously printed in a given print pattern with a printing ratio of 6% under a normal temperature and normal humidity environment (23° C., 45%), the state of peripheral areas of the developing roller attached in the developing device and printed images were visually checked to thereby evaluate each of the toners. Here, the second toner can be applied over the surface of the toner layer thickness controlling blade by a conventional method, using a brush or a brush which is rotatable by engine power.

The magenta toners T2*a*/T2*b* to T16*a*/T16*b* were also used and evaluated in the same manner as described for the toners T1*a*/T1*b*.

Evaluation items include background smear, toner bleed, toner scattering, streak lines on the developing roller and nonuniformity of image portions. The evaluation criteria of each of the evaluation items are as follows.

A: Excellent (No phenomena described in the respective evaluation items occurred.)

B: The state was on the level where there would be no problem in practical use. (A phenomenon described in the respective evaluation items occurred, however, the level of the occurrence of the problem did not matter practically.)

C: The state was on the level where there would be problems in practical use. (A phenomenon described in the respective evaluation items occurred on an unallowable scale).

(Measurement of Conveyance Amount M)

In the image forming apparatus, each of the toners within an area of 1 cm by 7 cm in size, i.e., 7 $cm^2$, on the developing roller surface was suctioned by means of a suction pump on the initial stage of printing, after printing 500 sheets, after printing 1,000 sheets and after printing 2,000 sheets, and the weight of each of the suctioned toner was measured to determine the conveyance amount M ($g/m^2$) of the toner onto the developing roller surface.

Tables 2-A and 2-B show the evaluation results on the state of each of the toners of Examples 1 to 10 and Comparative Examples 1 to 6 after actually used in an image forming apparatus, the state of peripheral areas of the developing roller of the developing device and the printed images.

TABLE 2-A

| | Configuration of developing device | | | Evaluation Result | | | | | | | | | | |
|---|---|---|---|---|---|---|---|---|---|---|---|---|---|---|
| | | | | Conveyance amount of toner M ($g/m^2$) | | | | | | Evaluation result after printing 2,000 sheets | | | | |
| | Magenta toner | Developing roller | Toner layer controlling member | Charged amount per unit mass (μC/g) | Initial stage (Ms) | After printing 500 sheets | After printing 1,000 sheets | After printing 2,000 sheets | Estimated evaluation of M (0.85 Ms < M < 1.35 Ms) | Background smear | Toner bleed | Toner scattering | Streak line on developing roller surface | Image nonuniformity |
| Ex. 1 | T1a<br>T1b | metal | resin | 35.0<br>30.7 | 4.5 | 5.2 | 5.5 | 5.4 | A (max. 1.22 Ms) | A | A | A | A | A |
| Ex. 2 | T2a<br>T2b | metal | resin | 32.1<br>28.6 | 4.4 | 4.9 | 5.4 | 5.2 | A (max. 1.23 Ms) | A | A | A | A | A |
| Ex. 3 | T3a<br>T3b | metal | resin | 37.8<br>32.4 | 4.8 | 5.6 | 5.8 | 5.7 | A (max. 1.21 Ms) | A | B | B | A | A |
| Ex. 4 | T4a<br>T4b | metal | resin | 25.5<br>21.2 | 4.3 | 4.5 | 4.6 | 4.7 | A (max. 1.09 Ms) | B | A | A | B | A |
| Ex. 5 | T5a<br>T5b | metal | resin | 39.7<br>38.0 | 5.3 | 5.9 | 6.0 | 5.8 | A (max. 1.13 Ms) | B | B | B | A | B |
| Ex. 6 | T6a<br>T6b | metal | resin | 42.3<br>38.4 | 5.8 | 6.2 | 6.3 | 5.8 | A (max. 1.09 Ms) | B | B | B | A | B |
| Ex. 7 | T7a<br>T7b | metal | resin | 36.8<br>32.2 | 4.7 | 5.3 | 5.4 | 5.2 | A (max. 1.15 Ms) | A | A | A | A | A |
| Ex. 8 | T8a<br>T8b | metal | resin | 36.1<br>31.6 | 4.6 | 5.3 | 5.5 | 5.3 | A (max. 1.20 Ms) | A | A | A | A | A |

TABLE 2-B

| | Configuration of developing device | | | Evaluation Result | | | | | | | | | | |
|---|---|---|---|---|---|---|---|---|---|---|---|---|---|---|
| | | | | Conveyance amount of toner M ($g/m^2$) | | | | | | Evaluation result after printing 2,000 sheets | | | | |
| | Magenta toner | Developing roller | Toner layer controlling member | Charged amount per unit mass (μC/g) | Initial stage (Ms) | After printing 500 sheets | After printing 1,000 sheets | After printing 2,000 sheets | Estimated evaluation of M (0.85 Ms < M < 1.35 Ms) | Background smear | Toner bleed | Toner scattering | Streak line on developing roller surface | Image nonuniformity |
| Ex. 9 | T9a<br>T9b | resin | metal | 35.0<br>27.6 | 4.1 | 4.7 | 5.1 | 5.2 | A (max. 1.27 Ms) | A | A | A | A | A |
| Ex. 10 | T10a<br>T10b | metal | resin | 35.0<br>29.2 | 4.4 | 5.0 | 5.3 | 5.3 | A (max. 1.20 Ms) | A | A | A | A | A |
| Compara. Ex. 1 | T11a<br>T11b | metal | resin | 43.7<br>39.7 | 6.2 | 7.1 | 7.3 | 5.0 | C (max. 1.18 Ms)<br>(min. 0.81 Ms) | C | C | C | A | C |

TABLE 2-B-continued

| | | Configuration of developing device | | Evaluation Result | | | | | | | | | | |
|---|---|---|---|---|---|---|---|---|---|---|---|---|---|---|
| | | | | Conveyance amount of toner M (g/m$^2$) | | | | | | Evaluation result after printing 2,000 sheets | | | | |
| | Magenta toner | Developing roller | Toner layer controlling member | Charged amount per unit mass (μC/g) | Initial stage (Ms) | After printing 500 sheets | After printing 1,000 sheets | After printing 2,000 sheets | Estimated evaluation of M (0.85 Ms < M < 1.35 Ms) | Background smear | Toner bleed | Toner scattering | Streak line on developing roller surface | Image nonuniformity |
| Compara. Ex. 2 | T12a<br>T12b | metal | resin | 29.8<br>17.5 | 4.3 | 4.7 | 4.8 | 3.5 | C (max. 1.12 Ms)<br>(min. 0.81 Ms) | C | C | C | B | A |
| Compara. Ex. 3 | T13a<br>T13b | metal | resin | 21.2<br>28.6 | 3.6 | 4.9 | 5.2 | 4.1 | C (max. 1.44 Ms) | C | B | C | C | A |
| Compara. Ex. 4 | T14a<br>T14b | metal | resin | 32.1<br>15.8 | 4.5 | 5.2 | 5.0 | 3.7 | C (max. 1.16 Ms)<br>(min. 0.82 Ms) | C | C | C | B | A |
| Compara. Ex. 5 | T15a<br>T15b | metal | resin | 41.9<br>38.5 | 6.4 | 7.5 | 6.9 | 5.1 | C (max. 1.17 Ms)<br>(min. 0.80 Ms) | C | C | C | C | C |
| Compara. Ex. 6 | T16a<br>T16b | metal | resin | 28.0<br>24.8 | 3.8 | 5.1 | 5.4 | 4.5 | C (max. 1.42 Ms) | C | C | C | B | B |

(In Tables 2-A and 2-B, "TNa" (N is an integer) in the column of "Magenta toner" represents the above-noted first toner, "TNb" (N is an integer) in the column of "Magenta toner" represents the above-noted second toner.)

With reference to Tables 1-A and 1-B and Tables 2-A and 2-B, according to Examples of the present invention, the second toner Tb (T1*b* to T10*b*), which was different from the first toner Ta (T1*a* to T10*a*) stored in the toner holding section in the developing device, had been preliminarily applied over the surface of the controlling member. In the process, it is preferable that inorganic fine particles to be added to the toner contain an inorganic fine particle composed of a composite oxide having a relative dielectric constant measured with 1 MHz of 2 to 10 and a volume resistivity of $10^{11}$ Ω·cm or more and a ratio of an additive amount "b" of the inorganic fine particle composed of the composite oxide in the second toner Tb that had been preliminarily applied over the surface of the controlling member to an additive amount "a" of the inorganic fine particle composed of the composite oxide in the first toner Ta stored in the toner holding section in the developing device satisfies the expression, $1<b/a<3$. By satisfying these conditions for toner, the toner conveyance amount, i.e., the amount of toner to be conveyed onto the developing roller can be set within a certain definite range to make it behave, and it is possible to not only prevent occurrence of background smear in non-image formed portions, toner bleed, toner scattering and streak lines on the developing roller but also to make nonuniformity of image-formed portions inconspicuous, thereby allowing for obtaining excellent image stability.

What is claimed is:

1. A developing device, comprising:

a toner conveying unit configured to convey a first toner, and a controlling member which is configured to control the thickness of a toner layer formed with the first toner and makes contact with the toner conveying unit, wherein a second toner provided with a charged amount per unit mass that differs from a charged amount per unit mass of the first toner is applied over the surface of the controlling member.

2. The developing device according to claim 1, wherein in the initial use of the developing device, the first toner has been stored in a toner holding section for storing the first toner to be subsequently supplied to the toner conveying unit and the second toner has been applied over the surface of the controlling member in the initial use of the developing device.

3. The developing device according to claim 1, wherein an absolute value (i) of the charged amount per unit mass of the second toner is lower than an absolute value (ii) of the charged amount per unit mass of the first toner.

4. The developing device according to claim 1, wherein the conveyance amount of the toner per unit area of the first toner held on the surface of the toner conveying unit after conveyed by the toner conveying unit and passed over the controlling member is 0.85 times greater to 1.35 times lower than the conveyance amount of the toner per unit area of the first toner held on the surface of the toner conveying unit after conveyed by the toner conveying unit and passed over the controlling member in the initial use of the developing device.

5. The developing device according to claim 1, wherein the first toner and the second toner differ in compounding ratio of external additives from each other.

6. The developing device according to claim 1, wherein at least any one of the first toner and the second toner comprises an inorganic fine particle composed of a composite oxide having a relative dielectric constant measured with 1 MHz of 2 to 10 and a volume resistivity of $10^{11}$ Ω·cm or more.

7. The developing device according to claim 6, wherein the inorganic fine particle composed of a composite oxide comprises a composite oxide represented by the following General Formula I, $$[M1]_a Si_b O_c \qquad \text{General Formula I}$$

where "M1" represents a metal element selected from strontium (Sr), magnesium (Mg), zinc (Zn), cobalt (Co), manganese (Mn) and cerium (Ce); "a" and "b" respectively an integer of 1 to 9; and "c" is an integer of 3 to 9.

8. The developing device according to claim 7, wherein the inorganic fine particle composed of a composite oxide comprises any one of steatite and forsterite.

9. The developing device according to claim 6, wherein a ratio of the additive amount of the inorganic fine particle composed of the composite oxide contained in the second toner to the additive amount of the inorganic fine particle composed of the composite oxide contained in the first toner is greater than 1 and lower than 3.

10. The developing device according to claim 6, wherein the primary particle diameter of the inorganic fine particle composed of a composite oxide is 0.05 μm to 1 μm, and the additive amount of the inorganic fine particle composed of the composite oxide is 0.1 parts by mass to 1.5 parts by mass to 100 parts by mass of the toner base.

11. An image forming apparatus, comprising:

a developing device, wherein the developing device comprises a toner conveying unit configured to convey a first toner, and a controlling member which is configured to control the thickness of a toner layer formed with the first toner and makes contact with the toner conveying unit, wherein a second toner provided with a charged amount per unit mass that differs from a charged amount per unit mass of the first toner is applied over the surface of the controlling member.

12. An image forming method, comprising:

forming an image using a developing device, wherein the developing device comprises a toner conveying unit configured to convey a first toner, and a controlling member which is configured to control the thickness of a toner layer formed with the first toner and makes contact with the toner conveying unit, wherein a second toner provided with a charged amount per unit mass that differs from a charged amount per unit mass of the first toner is applied over the surface of the controlling member.

* * * * *